United States Patent [19]

Ludwick et al.

[11] 4,442,356

[45] Apr. 10, 1984

[54] CORONA WIRE ASSEMBLY AND METHOD

[75] Inventors: Sandra L. Ludwick, Broomfield; Stanley L. Pond, Boulder County; Robert T. Rhodes, Longmont, all of Colo.

[73] Assignee: International Business Machines Corporation, Armonk, N.Y.

[21] Appl. No.: 294,945

[22] Filed: Aug. 21, 1981

[51] Int. Cl.[3] ..... H01T 19/04

[52] U.S. Cl. ..... 250/324; 361/230

[58] Field of Search ..... 250/324, 325; 339/97 R, 339/97 C; 361/230, 222

[56] References Cited

U.S. PATENT DOCUMENTS

| | | | |
|---|---|---|---|
| 3,897,992 | 8/1975 | Weidler | 339/97 C |
| 4,089,600 | 5/1978 | Yoshio et al. | 355/3 |
| 4,118,751 | 10/1978 | Hubble et al. | 250/32 X |
| 4,188,694 | 2/1980 | Rhodes | 29/25.17 |
| 4,320,957 | 3/1982 | Brown et al. | 250/324 |

OTHER PUBLICATIONS

IBM Technical Disclosure Bulletin, "Corona Wire Replacement", R. P. Crawford, 9/71, vol. 14, No. 4, p. 1218.

IBM Technical Disclosure Bulletin, "Corona Shell and Emission Wire Assembly", J. M. Adley, J. A. Barkley, D. Meza and R. T. Rhodes, 8/78, vol. 21, No. 3, pp. 923 and 924.

IBM Technical Disclosure Bulletin, "Corona Housing and Emission Wire Assembly", J. J. Abbott, L. M. Ernst, C. W. Knappenberger, W. E. McCollum, and B. L. Wilzbach, 6/79, vol. 22, No. 1, pp. 22–23.

Xerox Disclosure Journal, "Improved Corotron Electrode Holding Device", D. A. Seanor, May/Jun. 1979, vol. 4, No. 3, p. 323.

Xerox Disclosure Journal, "Ceramic Dicorotron Endblocks", J. Laing and J. Nagel, Jul./Aug., 1979, vol. 4, No. 4, pp. 497–498.

Xerox Disclosure Journal, "Corotron Wire Tensioner", D. Gilliver, Sep./Oct., 1979, vol. 4, No. 5, p. 605.

*Primary Examiner*—Bruce C. Anderson

*Attorney, Agent, or Firm*—Gunter A. Hauptman; Earl C. Hancock

[57] ABSTRACT

A copier's corona assembly carries arms holding a corona emission wire between a tensioning spring and current limiting resistor. Slugs secure the corona wire to the spring and resistor under tension provided by the arms and the spring while, simultaneously, facilitating a current path through the wire assembly formed by the wire, spring, resistor, and slugs. The slugs, made of a deformable metal receive, in a slot, a corona wire and one lead of the resistor or one end of the spring. A press closes the slot and crimps the slug closed to securely fasten together the wire and the lead or end.

2 Claims, 8 Drawing Figures

CORONA WIRE ASSEMBLY AND METHOD

BACKGROUND OF THE INVENTION

1. Field of the Invention

The invention is directed to an electrode mounting method and assembly. More particularly, the invention is directed to a method for connecting a copier's corona wires to terminal components and to the combination resulting therefrom.

2. Description of the Prior Art

Corona wires in electrophotographic copying machines emit charges when connected to a high voltage through current limiting resistors and tensioning springs. The emission wires, resistors and springs, made of dissimilar materials, connect to electrical terminals which mechanically anchor the parts. Conventional electrical bonding methods, such as twisting or soldering, do not reliably form long-lived conductive joints. Other techniques require complex manual assembly or expensive precision parts. In U.S. Pat. No. 4,188,694, loops anchored by die castings attach corona grid wires to spring arms. In IBM TECHNICAL DISCLOSURE BULLETIN, June 1979, pages 22–23, a resistor and spring are attached to an emission wire by a loop and to a terminal by crimping or welding.

SUMMARY OF THE INVENTION

The invention permits rapid, reliable and automatic assembly of emission wires and their components. By closing slots in two deformable slugs of die-cast metal, one end of an emission wire joins to a resistor and the other end to a spring. Each slot receives a wire end, and either a resistor lead or a spring arm, and then joins the wire to the other component mechanically and electrically when a press deforms the slug.

DETAILED DESCRIPTION

Figure 1:
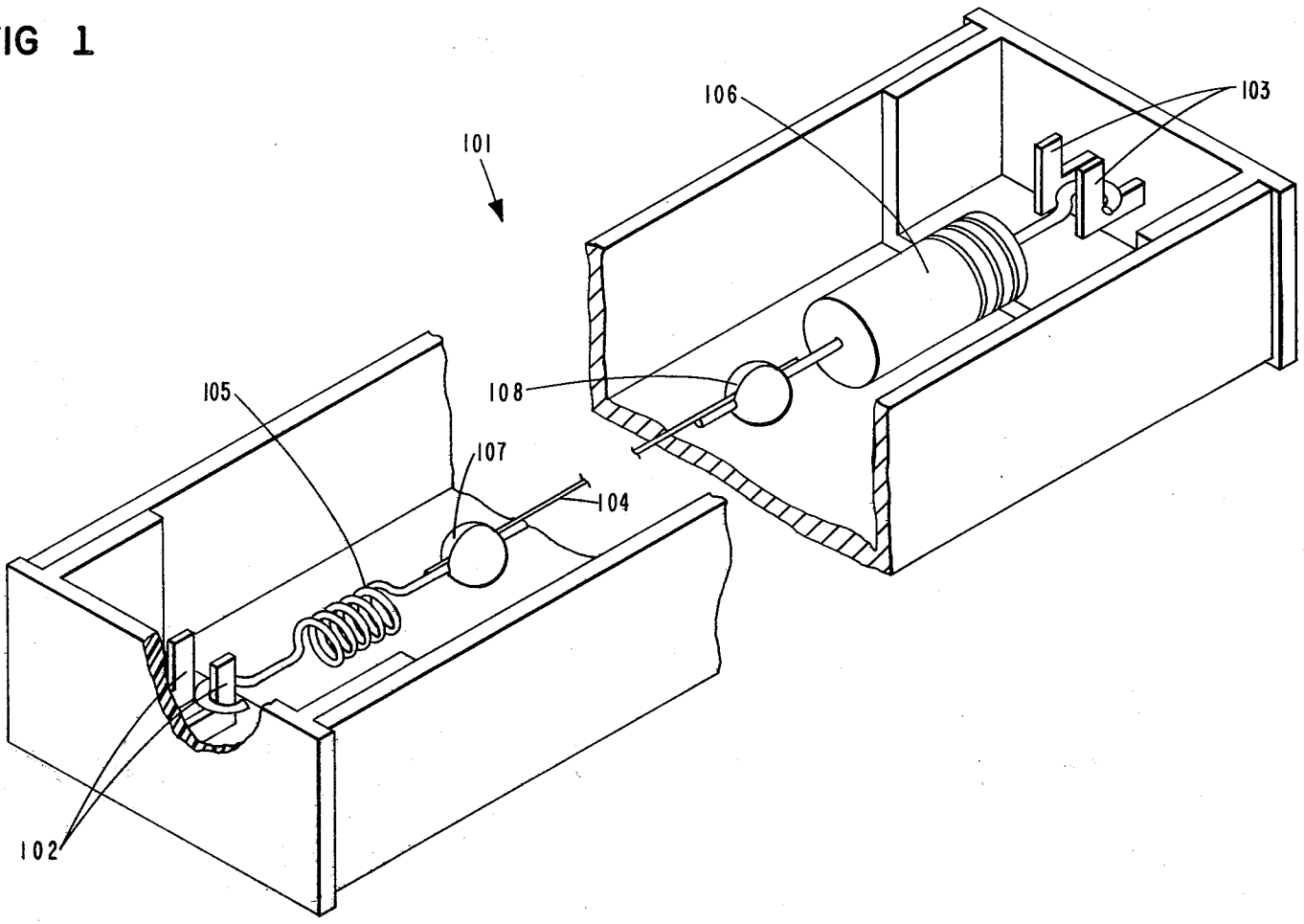
FIG. 1 shows a corona assembly and wire assembly.

In FIG. 1, a corona assembly 101 carries arms 102 and 103 holding a corona emission wire 104 between a tensioning spring 105 and current limiting resistor 106. Additional emission wires 104 may be provided inside the same, or a larger, assembly 101. Slugs 107 and 108 secure the corona wire 104 to the spring 105 and resistor 106 under tension provided by the arms 102 and 103 and the spring 105 while, simultaneously, facilitating a current path through the wire assembly formed by the wire 104, spring 105, resistor 106 and slugs 107 and 108.

Figure 2A:
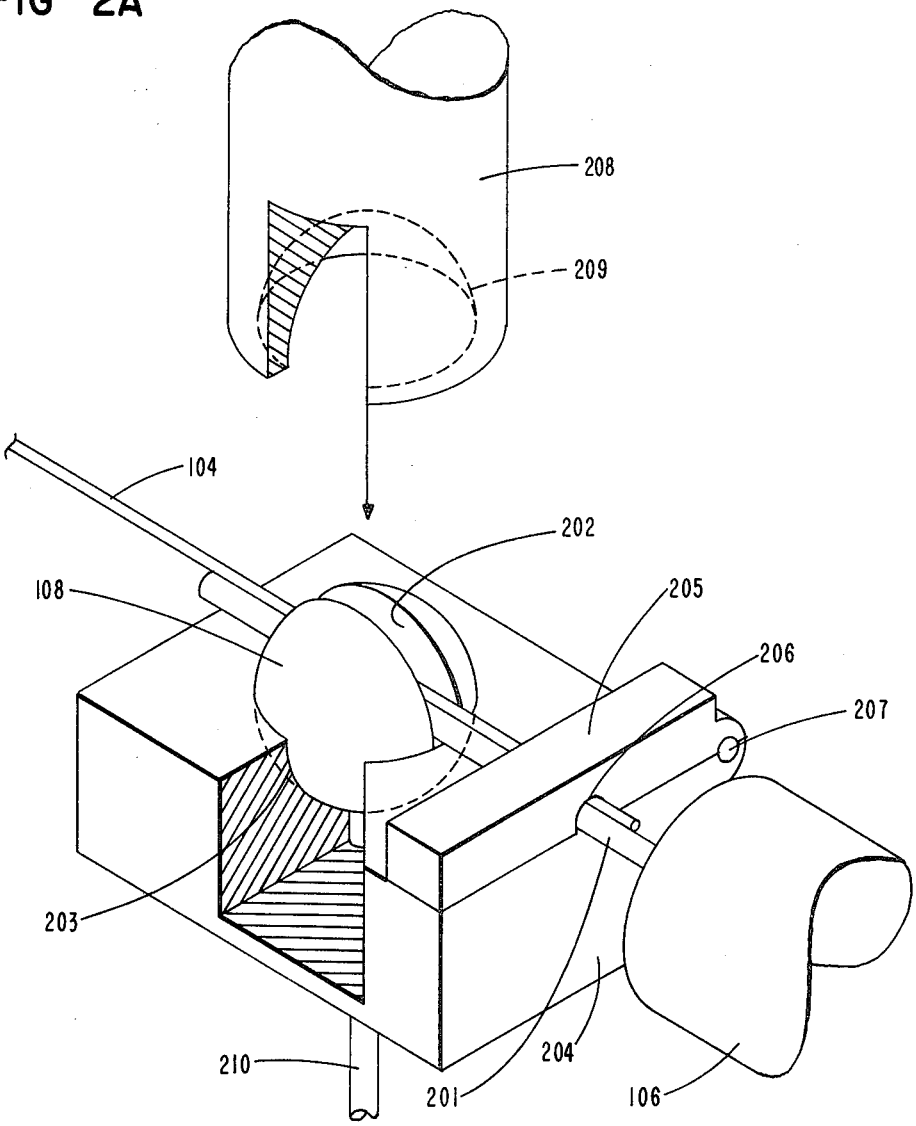
FIGS. 2A, 2B, 3A, and 3B show two embodiments of slugs usable in the invention, and methods of assembling corona wires with the slugs.
Figure 2B:
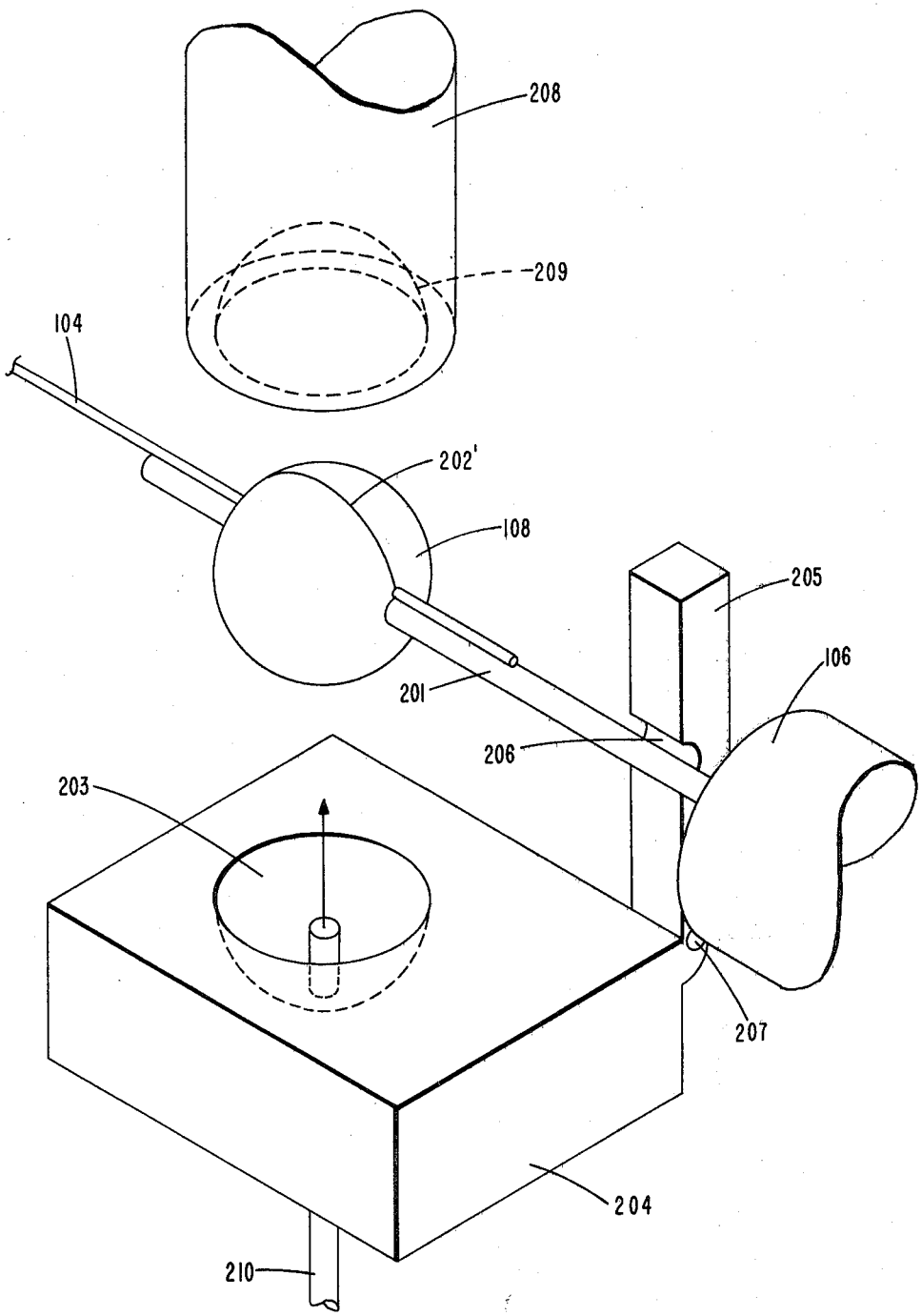

Details of slug 108 and how it attaches resistor 106 to wire 104 appear in FIGS. 2A and 2B. The slug 108, made of a deformable metal such as lead, zinc, or the like, receives in a slot 202, a corona wire 104, usually made of a mechanically strong metal (tungsten or the like), and one lead 201, usually a conductor (for example, copper), of resistor 106. A cavity 203 in a die 204 holds the slug 108 while a clamp bar 205, pivoted around point 207 holds the wire 104 and lead 201 together in opening 206. An anvil 208 is driven downward by a press (not shown), capable of forces on the order of 2,000 pounds, until a cavity 209 surrounds slug 108 and closes the slot 202 (as shown by 202' in FIG. 2B). The slot in slug 108 is crimped closed to securely fasten together wire 104 and lead 201. A release bar 210 drives upward through die 204 to release the fastened components from the die 204 after the clamp bar 205 and anvil 208 move upward. Spring 105 may be fastened to wire 104 by slug 107 in an identical fashion, as will now be described.

Figure 3A:
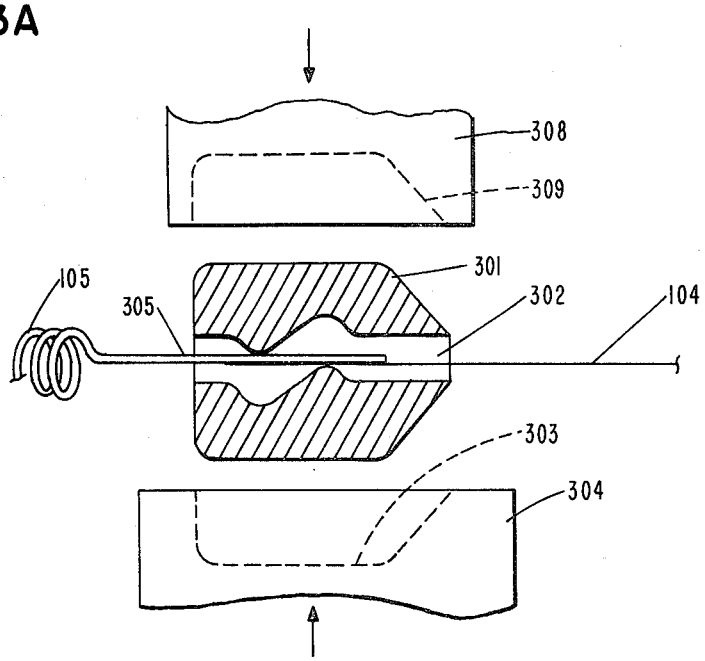
Figure 3B:
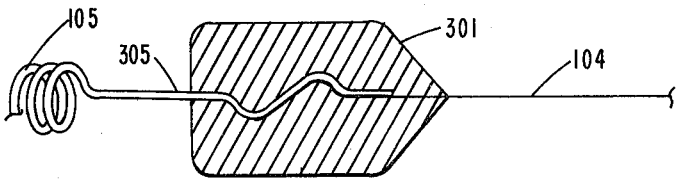

While a slug 301, shown in FIGS. 3A and 3B, differs from the slug 108 just described, they are interchangeable. Spring 105 wire end 305 and corona wire 104 rest in slug 301, slot 302. Slot 302 follows a nonlinear path to better secure the wires 305 and 104 together when slug 301 is coined (FIG. 2B) in the cavity 303 and 309 formed when dies 304 and 308 move together.

Figure 4:
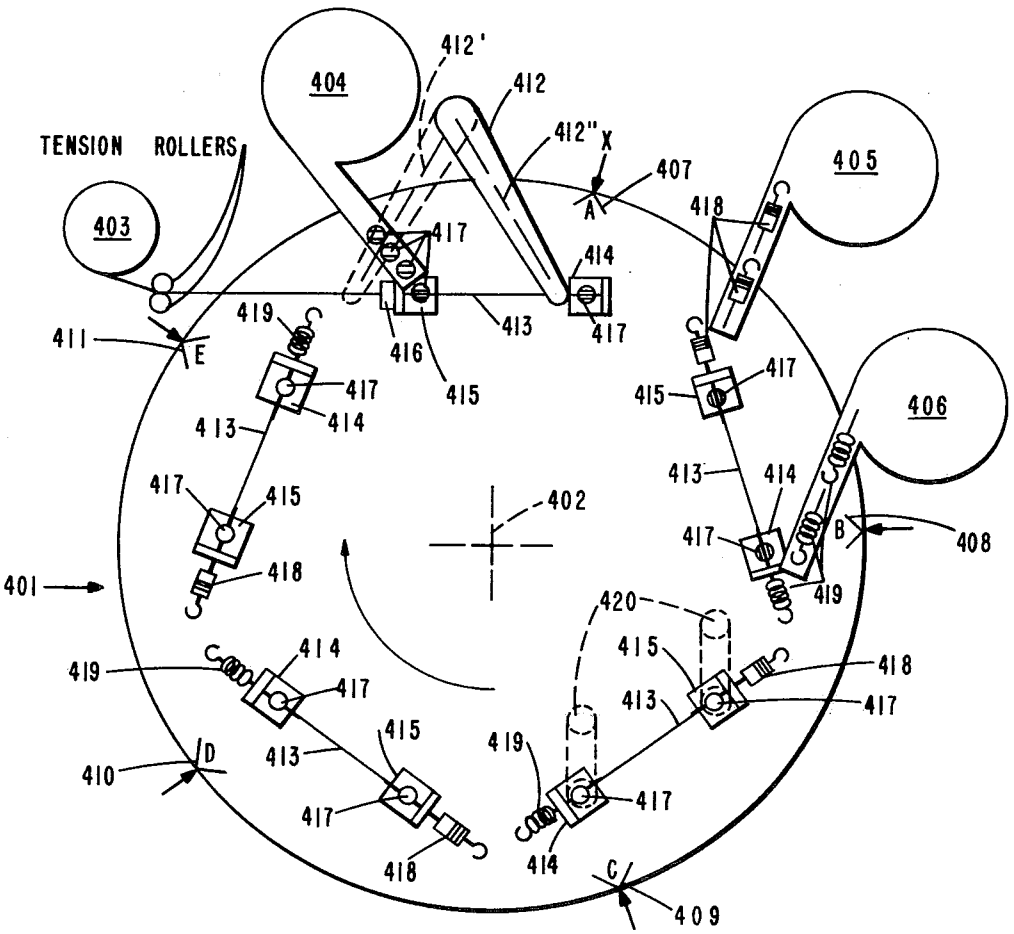
FIGS. 4, 5A and 5B show equipment for making a corona wire assembly.

A machine for practicing the invention appears in FIG. 4. A dial 401 rotates about point 402 past tools 403–406. A wire supply machine 403 provides a single length of corona wire, feeders or hoppers 404–406 provide slugs, resistors and springs, respectively, and a press 420 coins slugs. Conventional tools may be used; for example, a hopper-vibrator made by Hendricks Engineering, Inc., Indianapolis, Ind., is suitable. The dial 401 carries five work stations 407–411 (lettered work station "A" to work station "E"). For any one of five ("A"–"E" at point X) dial 401 positions, each of the work stations 407–409 is adjacent at least one of the four tools 403–406 and 420. Additionally, for the position of dial 401 shown in FIG. 4, a mechanical tester (not shown) at work station D 410 ascertains structural integrity of a corona wire assembly at that work station, and an appropriate automatic device (not shown) at work station E 411 unloads a tested assembly.

At work station A 407, wire transfer arm 412 described below with respect to FIGS. 5A and 5B, pulls a length of corona wire 413 from wire supply machine 403 as arm 412 moves from position 412' to position 412'' and back to 412' again. Wire clamps 414 and 415 hold the wire length 413 and a blade 416 severs it. At work station A 407, feeder 404 places two slugs 417 in the clamps 414 and 415 essentially as detailed in FIG. 2A. At work station B 408, feeder 405 places one appropriately trimmed resistor 418 in the clamp 415, and feeder 406 places one spring 419 in the clamp 414. At work station C 409, anvils 420 close slots in slugs 417 securing the corona wire assembly together. At work station D 410, the previously-described mchanical test, and any other mechanical or electrical test, may be performed prior to removal of the assembly at work station E 411.

Figure 5A:
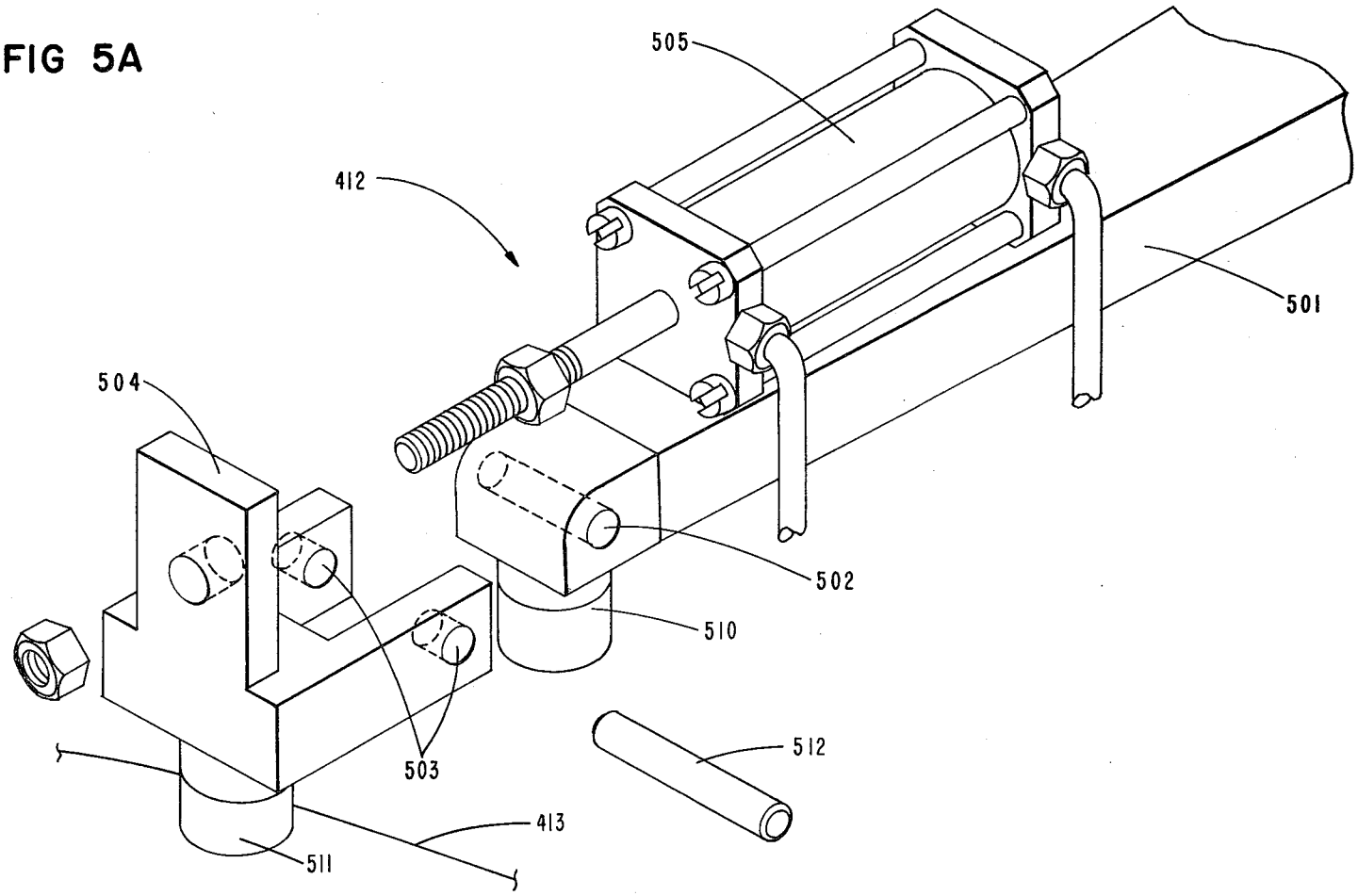
Figure 5B:
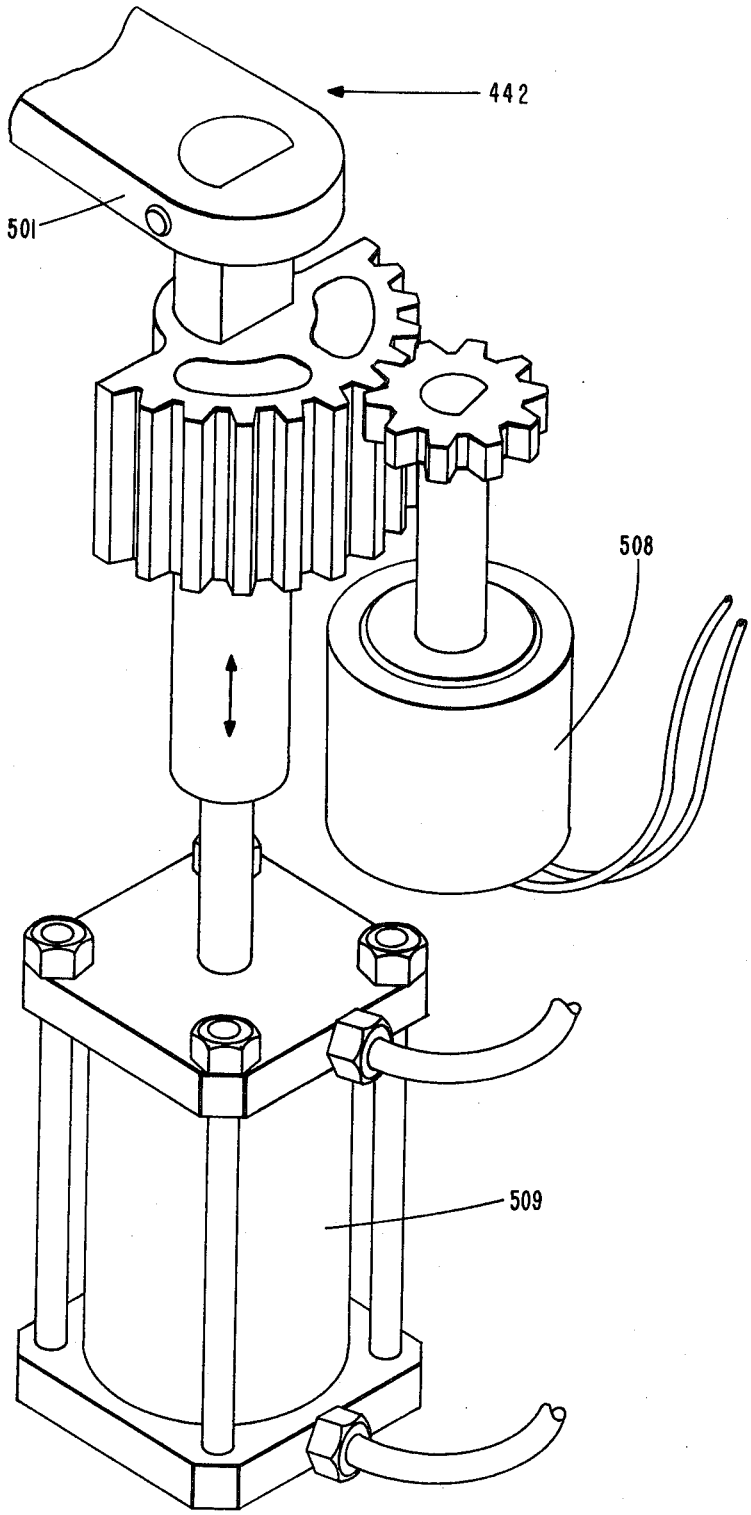

Referring to FIGS. 5A and 5B, the arm 412 at work station A 407 grips one end of corona wire 413, between studs 510 and 511 of arm 501. Studs 510 and 511 comprise removable lower sections constructed of a suitable wire-gripping material such as plastic or rubber or alternatively, are machined to form grooves for gripping the wire 413. Arm 412 swings from position 412' to 412'' and then drops arm 501 onto clamp 414. On the return path from position 412'' to 412', arm 412 allows wire 413 to slide freely between studs 510 and 511 while the arm 501 remains in its dropped position. Finally, at position 412', wire 413 is severed and a new end of wire 413 is gripped between studs 510 and 511 and the arm 501 raises up above the level of both clamps 414 and 415. The wire 413 is clamped between studs 510 and 511 when the clamp 504 pivots around stud 512, in holes 502 and 503, and moves relative the arm 501 upon activation of a solenoid 505. A motor 508 drives the arm 412 to positions 412' and 412''. A second solenoid 509 drops and raises the arm 501.

Operation of the invention will be described with respect to all the Figures. Initially, station A is left of position X. As clamp 414 on rotary dial 401, work station A 407, passes tool 404, one slug 417 drops into clamp 414. When the dial 401 work station A 407 stops at position X, another slug 417 drops into clamp 415. Tool 403 loads a wire 413 through slots 202 of slugs 417 and between clamps 414 and 415. This occurs when solenoid 505 clamps wire 413 between studs 510 and 511, solenoid 509 raises the arm 501, motor 508 moves arm 412 to position 412'', blade 416 severs wire 413, solenoid 509 lowers the arm 501, and solenoid 505 releases the clamping force on wire 413 and slides arm 412 back to position 412'.

The dial 401 moves work station E to position X. With work station A 407 at tools 405 and 406, work station E is presented to tools 403 and 404 as just described. A resistor 418 is placed in slug 417 slot 202 at clamp 415, and a spring 419 is placed in slug 417 slot 202 at clamp 414. When the dial advances work station D to position X and work station A 407 to tool 420, each of the preceding operations is performed on the next one in line of work stations D and E. Anvils 420 coin slugs 417 of work station A by closing slots 202 around wire 413, spring 419 and resistor 418. Work station C then advances to position X and work station A goes to a test position while work station E advances to the tool 420, and work station D advances to the tool 405.

Finally, work station A reaches the last removal position and is ready to be loaded with slugs 417 and wire 413 again.

While the invention has been particularly shown an described with reference to preferred embodiments thereof, it will be understood by those skilled in the art that various changes in form and details may be made therein without departing from the spirit and scope of the invention.

What is claimed is:

1. In a copier, a corona emission wire assembly comprising the combination of:

a conductive and high strength emission wire;

a supporting structure, having arms, for mechanically retaining the wire under tension and electrically connecting the wire to an external circuit;

a tension spring connectable between one end of the wire and an arm of the structure;

a resistor connectable between another end of the wire and another arm of the structure; and first and second deformable connectors, each connector having a slot for concurrently receiving one end of the wire and a lead from one of said spring or resistor, for mechanically and electrically joining them when the connector is deformed to compress them in the slot, the first connector joining one end of the wire and a lead of the tension spring, and the second connector joining the opposite end of the wire and a lead of the resistor.

2. The assembly in accordance with claim 1 wherein at least one of the slots of the deformable connectors is formed as a tortuous path.

* * * * *